United States Patent [19]

Fikentscher et al.

[11] Patent Number: 4,911,888

[45] Date of Patent: Mar. 27, 1990

[54] USE OF SALTS OF SULFONAMIDOCARBOXYLIC ACIDS AS CORROSION INHIBITORS IN AQUEOUS SYSTEMS

[75] Inventors: Rolf Fikentscher; Gerold Braun, both of Ludwigshafen; Chung-Ji Tschang, Bad Durkheim; Christos Vamvakaris, Kallstadt; Reinhold Kohlhaupt, Frankenthal, all of Fed. Rep. of Germany

[73] Assignee: BASF Aktiengesellschaft, Ludwigshafen, Fed. Rep. of Germany

[21] Appl. No.: 202,244

[22] Filed: Jun. 6, 1988

[30] Foreign Application Priority Data

Jun. 6, 1987 [DE] Fed. Rep. of Germany ..... 3719046

[51] Int. Cl.[4] ..... C23F 11/12; C23F 11/14; C23F 11/16

[52] U.S. Cl. ..... 422/16; 252/394; 252/395; 252/396; 422/13; 422/17

[58] Field of Search ..... 422/13, 16, 17; 252/394–396

[56] References Cited

U.S. PATENT DOCUMENTS 3,556,994 1/1971 Diery et al. .
4,297,236 10/1981 Diery et al. ..... 422/17
4,344,862 8/1982 Widder et al. ..... 422/17

FOREIGN PATENT DOCUMENTS 3330223 3/1985 Fed. Rep. of Germany .

OTHER PUBLICATIONS

Seifen-Öle-Fette-Wachse, 105, Nr. 6, 1979, pp. 167–168.
Seifen, Ole, Fette, Wachse; vol. 103, pp. 167–168 (1977).
Entry for "aryl" from *Concise Chemical and Technical Dictionary,* 4th Ed., Chemical Publishing Co. Inc.

*Primary Examiner*—Barry S. Richman
*Assistant Examiner*—Timothy McMahon
*Attorney, Agent, or Firm*—Oblon, Spivak, McClelland, Maier & Neustadt

[57] ABSTRACT

Specific sulfonamidocarboxylic acids in the form of the alkali metal or alkanolamine salts are used as corrosion inhibitors in aqueous systems.

5 Claims, No Drawings

USE OF SALTS OF SULFONAMIDOCARBOXYLIC ACIDS AS CORROSION INHIBITORS IN AQUEOUS SYSTEMS

The present invention relates to the use of specific sulfonamidocarboxylic acids in the form of alkali metal or alkanolamine salts as corrosion inhibitors in aqueous systems.

In industrial processes, for example purification, pressure transmission and cooling processes which take place in the presence of water, the problem of corrosion protection constantly arises when corrodable metals, such as copper, iron, aluminum, or their alloys or, for example, soft solder, are involved in these processes. For inhibiting corrosion, a large number of inhibitors have recently been proposed, in particular organic compounds, such as acylsarcosides, amines, alkanolamines, amides of long-chain fatty acids and also certain sulfonamidocarboxylic acids [cf. for example Seifen, Öle, Fette, Wachse, 130, Part 6 (1979), 167–168].

Furthermore, for example, German Patent 1,298,672 discloses that the reaction products of aliphatic ω-amino acids where the carboxyl side chain is of more than 3 carbon atoms with aromatic sulfonyl chlorides can be used as corrosion inhibitors, particularly in the form of the triethanolamine salts.

DE-A1-33 30 223 likewise describes the salts of the reaction products of alkylbenzenesulfonyl chlorides with glycine or methylglycine as corrosion inhibitors in aqueous systems.

The corrosion-inhibiting properties of the sulfonamidocarboxylic acids described above are not always optimum. Frequently, the actual corrosion-inhibiting effect is inadequate, so that relatively large amounts have to be used. In some cases, foam formation is excessive, and the water solubility and sensitivity to water hardness, which are of considerable importance, may be unsatisfactory in certain circumstances. Furthermore, the toxicity of the substances used may play an important role.

It is an object of the present invention to provide substances which have low toxicity and optimum properties in aqueous systems, ensuring good corrosion inhibition as well as a low level of foam and having little sensitivity to water hardness.

We have found that this object is achieved and that, surprisingly, excellent results are obtained if a compound of the formula I

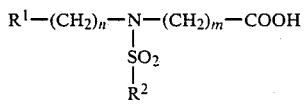

$$R^1-(CH_2)_n-\underset{\underset{R^2}{|}}{\overset{\overset{SO_2}{|}}{N}}-(CH_2)_m-COOH$$

where $R^1$ and $R^2$ are each phenyl which is unsubstituted or monosubstituted or disubstituted by alkyl of 1 to 6 carbon atoms, n is 0, 1 or 2 and m is 1 or 2, in the form of an alkali metal salt or an alkanolamine salt, is used as a corrosion inhibitor ion aqueous systems.

The present invention furthermore relates to a method for preventing corrosion in aqueous systems, wherein a compound of the formula I, in the form of an alkali metal salt or alkanolamine salt, is added to the aqueous system as a corrosion inhibitor.

The salts of the formula I can also be used in the form of their mixtures.

Alkyl of 1 to 6 carbon atoms, with which the phenyl radicals may be monosubstituted or disubstituted, is, for exmaple, methyl, ethyl, propyl, isopropyl, butyl, pentyl or hexyl. The higher alkyl radicals of 3 to 6 carbon atoms are particularly suitable in the case of monosubstitution.

Noteworthy compounds of the formula I are those in which $R^1$ and $R^2$ are each phenyl or tolyl, n is 0 and m is 1 or 2. Preferred tolyl radicals are o-tolyl and p-tolyl.

Preferred compounds to be used according to the invention in aqueous systems are, in the case of alkali metal salts, the sodium and potassium salts, and, in the case of alkanolammonium salts, the salts of mono-, di- or trihydroxyalkylamines, where hydroxyalkyl is of 2 to 4 carbon atoms, and mono-($C_2$–$C_4$)-hydroxyalkylmono- or -dialkylamines, where alkyl is of 1 to 4 carbon atoms, and di-($C_2$–$C_4$)-hydroxyalkylmono-($C_1$–$C_4$)-alkylamines.

Preferred alkanolamines are mono-, di- and triethanolamine, mono-, di- and trihydroxyisopropylamine and N-methyldiethanolamine and dimethylmonoethanolamine. In practice, it is not only the pure alkanolamines which are used but also their mixtures as obtained in industrial production.

The acids of the formula I are in principle known from the literature and can be prepared by a conventional method. The use of their alkanolamine salts as corrosion inhibitors is not described anywhere in the literature.

The acids of the formula I are advantageously converted into the corresponding salt using the abovementioned alkanolamines in a molar ratio of from 1:1 to 1:4. In order to obtain a pH of from 8.0 to 8.8, which is advantageous in practice, excess amounts of alkanolamine are generally used.

In the case of the compounds described in the prior art, the sulfonamide nitrogen atom has a hydrogen atom or an alkyl radical, preferably methyl, as a substituent. The compounds of the formula I which are to be used according to the invention carry, on the nitrogen atom, an aromatic radical or an alkyl radical substituted by an aromatic radical, in conformity with the meanings of $R^1$ and n. As a result of the present invention, the sulfonamidocarboxylic acids substituted by aromatic radicals will become industrially useful for the first time. Since corrosion inhibition and foaming behavior are very sensitive properties which cannot be predicted, the superior actions were not obvious, despite the relatively small structural differences.

The corrosion inhibitors according to the invention can be used in all aqueous systems which come into contact with iron or its alloys (steels), aluminum or its alloys, zinc or copper or their alloys. Examples are hydraulic fluids, cooling lubricants, neutral to alkaline industrial cleaners, additives to cooling water, radiator protection agents and mine waters which are particularly hard, have a particularly high salt content, are used in mining directly as mixing water, for example hydraulic processes, and are particularly highly corrosive. The aqueous systems advantageously have a pH of from 8.0 to 8.8.

The concentrations in practical use vary depending on the application and the type of aqueous medium and on the metals to be protected. In general, from 0.01 to 5% by weight, based on the aqueous system, are used. The use of amounts below this limit generally results in a poorer protective effect, while exceeding the limit has no additional advantages. The concentration is preferably from 0.1 to 2% by weight.

As for the rest, the usual additives can be used in the preparation of the conventional formulations.

The Examples (Table 1) which follow illustrate the invention without restricting it.

TABLE 1

| Compound | n | Formula I with m | $R^1$ | $R^2$ | Base |
|---|---|---|---|---|---|
| A | 0 | 1 | phenyl | phenyl | TEA[1] |
| B | 2 | 1 | phenyl | phenyl | TEA |
| C | 0 | 1 | o-tolyl | phenyl | TEA |
| D | 0 | 1 | phenyl | tolyl | TEA |
| E | 0 | 2 | phenyl | phenyl | TEA |
| F | 1 | 2 | phenyl | phenyl | TEA |
| G | | N-methylbenzenesulfonamidocaproic acid (German Patent 1,298,672, Example 5) | | | TEA |

[1]TEA = triethanolamine

The corrosion inhibition effect is determined according to DIN Test 51,360, Part 2. The sulfonamidocarboxylic acid to be investigated is mixed with triethanolamine (TEA) in an amount such that a 1% strength by weight aqueous solution has a pH of 8.2±0.1

2 and 3% strength by weight solutions of this mixture, having a certain water hardness, are used according to the DIN method.

Table 2 shows the results obtained, including a comparison with N-methylbenzenesulfonamidocaproic acid (commercially available).

The rating scale is as follows:

4=very pronounced corrosion

3=pronounced corrosion

2=moderate corrosion

1=slight corrosion

0=no corrosion

TABLE 2

| Compound | Corrosion 2% strength by weight solution | Corrosion 3% strength by weight solution | pH |
|---|---|---|---|
| A | 0 | 0 | 8.2 |
| B | 0–1 | 0 | 8.3 |
| C | 0 | 0 | 8.3 |
| D | 0 | 0 | 8.2 |
| E | 0–1 | 0 | 8.2 |
| F | 0–1 | 0 | 8.4 |
| G | 2 | 0–1 | 8.3 |

The results show that 2% strength by weight solutions are sufficient for achieving corrosion inhibition superior to that obtained using the commercial compound.

We claim:

1. A method for preventing corrosion of metal in contact with a corrosive aqueous medium, wherein a compound of the formula I

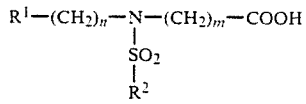

where $R^1$ and $R^2$ are phenyl which is unsubstituted or monosubstituted or disubstituted by alkyl of 1 to 6 carbon atoms, n is 0, 1 or 2 and m is 1 or 2, in the form of an alkali metal salt or an alkanolamine salt, is added to the corrosive aqueous medium as a corrosion inhibitor.

2. A method as claimed in claim 1, wherein a compound of the formula I as claimed in claim 1, in which $R^1$ and $R^2$ are each phenyl or tolyl, n is 0 and m is 1 or 2, added to the corrosive aqueous medium.

3. A method as claimed in claim 1 or 2, wherein a compound of the formula I as claimed in claim 1 or 2 is added in an amount of from 0.01 to 5% by weight, based on the corrosive aqueous medium.

4. A method as claimed in claim 1 or 2, wherein a compund of the formula I as claimed in claim 1 or 2 is added in an amount of from 0.1 to 2% by weight, based on the corrosive aqueous medium.

5. A method as claimed in claim 1 or 2, wherein said corrosive aqueous medium has a pH of from 8.0 to 8.8 and said metal is selected from the group consisting of iron, aluminum, zinc, copper or their alloys.

* * * * *